US006113453A

United States Patent [19]

Stuffelbeam

[11] Patent Number: 6,113,453

[45] Date of Patent: Sep. 5, 2000

[54] FLYING TOY APPARATUS AND ASSEMBLY METHOD

[76] Inventor: Kim Stuffelbeam, 7851 Brookside Ave., Sebastopol, Calif. 94572

[21] Appl. No.: 09/001,037

[22] Filed: Dec. 30, 1997

Related U.S. Application Data

[60] Provisional application No. 60/064,904, Nov. 7, 1997.

[51] Int. Cl.[7] ..... A63H 27/00; A63B 67/06

[52] U.S. Cl. ..... 446/46; 446/48; 446/236; 473/589

[58] Field of Search ..... 446/46, 48, 74, 446/236; 473/411, 589

[56] References Cited

U.S. PATENT DOCUMENTS

| | | | |
|---|---|---|---|
| 3,765,122 | 10/1973 | English | 446/48 |
| 4,104,822 | 8/1978 | Rodgers | 446/48 |
| 4,241,533 | 12/1980 | Newsome | 446/46 |
| 4,380,885 | 4/1983 | Komagata | 446/236 |
| 4,503,635 | 3/1985 | Harrington | 446/46 |
| 4,560,358 | 12/1985 | Adler | 446/46 |
| 4,820,230 | 4/1989 | Richards | 446/46 |
| 4,915,661 | 4/1990 | Getgey | 446/48 |
| 4,940,441 | 7/1990 | Novinsky | 446/46 |
| 4,944,707 | 7/1990 | Silverglate . | |
| 4,973,284 | 11/1990 | Sassak | 446/48 |
| 5,261,846 | 11/1993 | Hanna | 446/46 |
| 5,356,132 | 10/1994 | McEwan et al. . | |
| 5,358,440 | 10/1994 | Zheng | 446/48 |
| 5,362,067 | 11/1994 | Nelson | 446/48 |
| 5,366,403 | 11/1994 | Weiss | 446/46 |
| 5,480,334 | 1/1996 | Wilson et al. | 446/46 |
| 5,490,806 | 2/1996 | Spector | 446/48 |
| 5,538,454 | 7/1996 | Kessler . | |
| 5,655,947 | 8/1997 | Chen | 446/46 |

*Primary Examiner*—Kien T. Nguyen
*Assistant Examiner*—Michael B. Priddy
*Attorney, Agent, or Firm*—Gerald R. Black

[57] ABSTRACT

The flying toy apparatus has improved launch and flight characteristics, is compatible either as a flying hoop-type structure or a disc-type structure, and can be readily disassembled for compact storage. The flying toy apparatus comprises an outer section and a central floatation member. The outer section includes an annular ring made of a solid material encased within a cushion-type material. The solid material enables firm grasping of the outer annular section during launch. The cushion-type material encases the annular ring and lessens any force imposed by the annular ring upon impact. By substituting one outer ring structure with a slightly different outer ring structure, the flying toy apparatus can be readily adapted for any variety of flight patterns.

18 Claims, 6 Drawing Sheets

FIG-2A
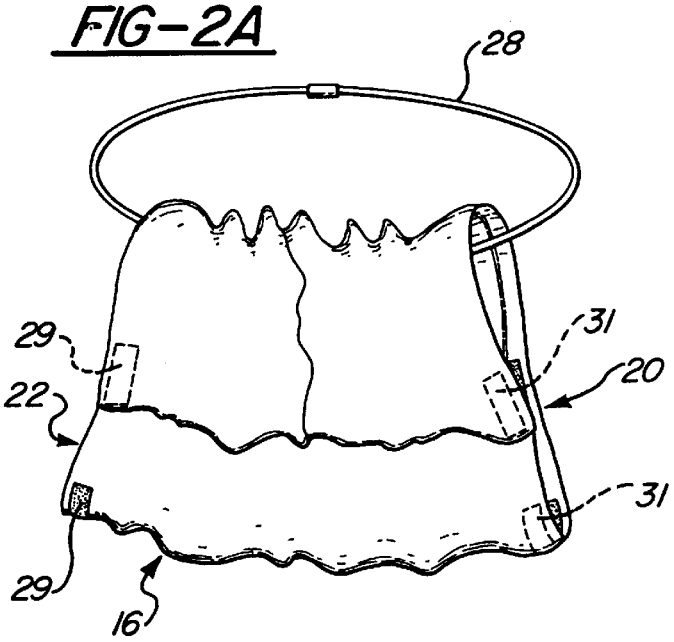
FIG-2C
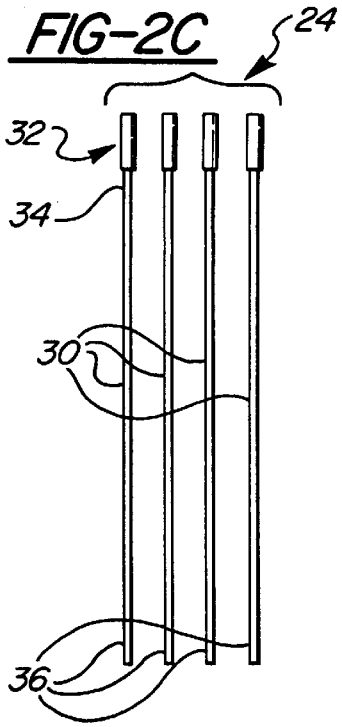
FIG-2B
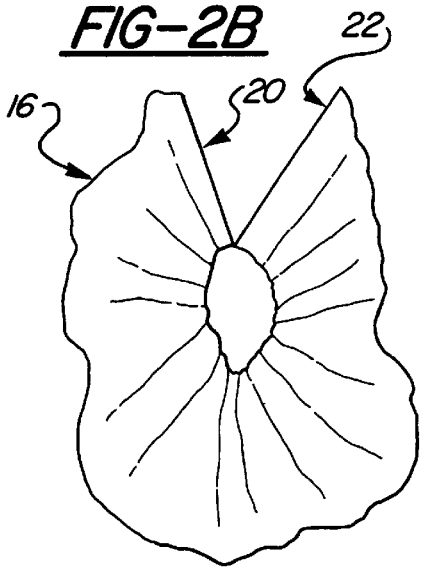
FIG-2E
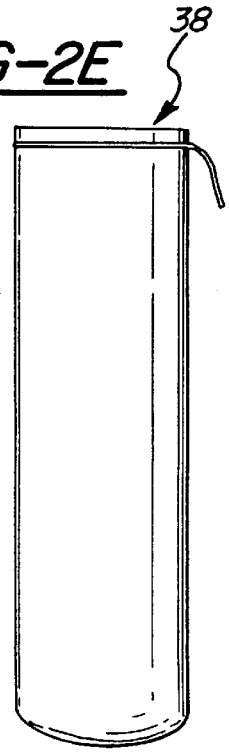
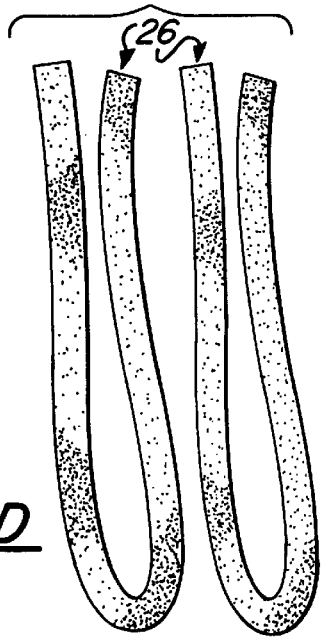
FIG-2D 34
32
30
36

32
30
36
52
30

26
30

52
56
54
52
56
54

FLYING TOY APPARATUS AND ASSEMBLY METHOD

This Application claims the benefit of U.S. Provisional Application No. 00/064,904 filed on Nov. 7, 1997.

FIELD OF USE

The present invention relates generally to a flying toy apparatus and, more specifically, to a flying toy having improved and prolonged flight patterns.

BACKGROUND OF THE INVENTION

Various types of flying disc-shaped toys are commercially available, the Frisbee® being the most popular. The Frisbee® can be thrown over relatively long distances due to the high peripheral mass distribution and rigidity of the structure. However, considerable practice is required before any degree of skill is achieved. Also, the disc is generally thrown with a backhand motion and is difficult to control. Also, the disc is hard and causes damage or injury upon impact.

U.S. Pat. No. 4,944,707 discloses another flying toy apparatus. The annular ring-like structure is readily deformable upon impact and is designed for use indoors. However, having almost no structural rigidity, the toy is of little value outdoors and is hard to launch for flight over longer distances.

What is needed is a structure that combines the launch characteristics of the Frisbee® with the improved impact characteristics of the toy apparatus described in the '707 patent.

What is needed is a rigid outer member that is compatible with both a forehand and a backhand manual launch, and is also compatible with a mechanical launch.

What is needed is a new design that is compatible either as a flying hoop-type structure or a disc-type structure.

What is needed is a flying toy apparatus with improved flight characteristics.

What is needed is a flying toy apparatus that is useful in larger designs but can be readily disassembled for compact storage and reassembled for subsequent use at a later time.

What is needed is a flying toy apparatus that can be readily adapted for any variety of flight patterns by substituting one outer ring structure with a slightly different outer ring structure.

SUMMARY OF THE INVENTION

The flying toy apparatus of the present invention comprises an outer section and a central floatation member. The solid material enables firm grasping of the outer annular section during launch. The cushion-type material encases the annular ring and lessens any force imposed by the annular ring upon impact. The outer section includes an annular ring made of a solid material encased within a cushion-type material.

The central floatation member is affixed and positioned within the outer annular section. The outer annular section in combination with the central floatation section form an airfoil, the airfoil shape enabling prolonged flight patterns. The central floatation member may have either a hollow center section, whereby the flying toy apparatus is a flying hoop-type structure, or the central floatation member may have a continuous surface disposed within the ring whereby the flying toy apparatus is a flying disc.

In one preferred embodiment, the annular ring has a circular cross-section, while in another preferred embodiment the annular ring has an asymmetrical cross-section. When the cross-section is asymmetrical, a variety of airfoils configurations may be incorporated into the design of the structure, each having differing flight patterns and characteristics.

In one preferred embodiment, the flying toy apparatus can be readily disassembled and stored in a compact manner for subsequent reassembly and reuse. The annular ring comprises a plurality of interconnecting individual segments and the cushion-type material comprises a plurality of segments. The central floatation member has a plurality of hooks and catches disposed therewithin to enable disassembly of the central floatation member, the interconnecting segments, and the cushion-type material.

The flying toy apparatus of the present invention can be assembled by preferably connecting each pair of the interconnecting segments together, the individual segments being attachable in a secure manner relative to each other in an axial direction; inserting one pair of the interconnected segments into the outer pocket of the sleeve; positioning each pair the interconnected segments into a cushion-type material within the sleeve; retaining outer extremities of each pair of the interconnecting segments together to form an annular ring structure; spreading the sleeve about the annular ring structure; and joining ends of the sleeve together to form a central floatation member, the central floatation section and the annular ring structure forming an airfoil.

For a more complete understanding of the flying toy apparatus and assembly method of the present invention, reference is made to the following detailed description and accompanying drawings in which the presently preferred embodiments of present invention are shown by way of example. As the invention may be embodied in many forms without departing from spirit of essential characteristics thereof, it is expressly understood that the drawings are for purposes of illustration and description only, and are not intended as a definition of the limits of the invention. Throughout the description, like reference numbers refer to the same component throughout the several views.

BRIEF DESCRIPTION OF THE DRAWINGS

FIG. 2A is an exploded view of the sleeve and shock cord of the flying toy apparatus of FIGS. 1A and 1B; FIG. 2B is an exploded view of the center floatation member in an unstretched condition of the flying toy apparatus of FIGS. 1A and 1B; FIG. 2C is an exploded view of the interconnecting ring segments of the flying toy apparatus of FIGS. 1A and 1B; FIG. 2D is an exploded view of the cushioned-cylinders of the flying toy apparatus of FIGS. 1A and 1B; and FIG. 2E is an exploded view of the stowing sack of the flying toy apparatus of FIGS. 1A and 1B;

DETAILED DESCRIPTION OF THE PREFERRED EMBODIMENTS

Figure 1A:
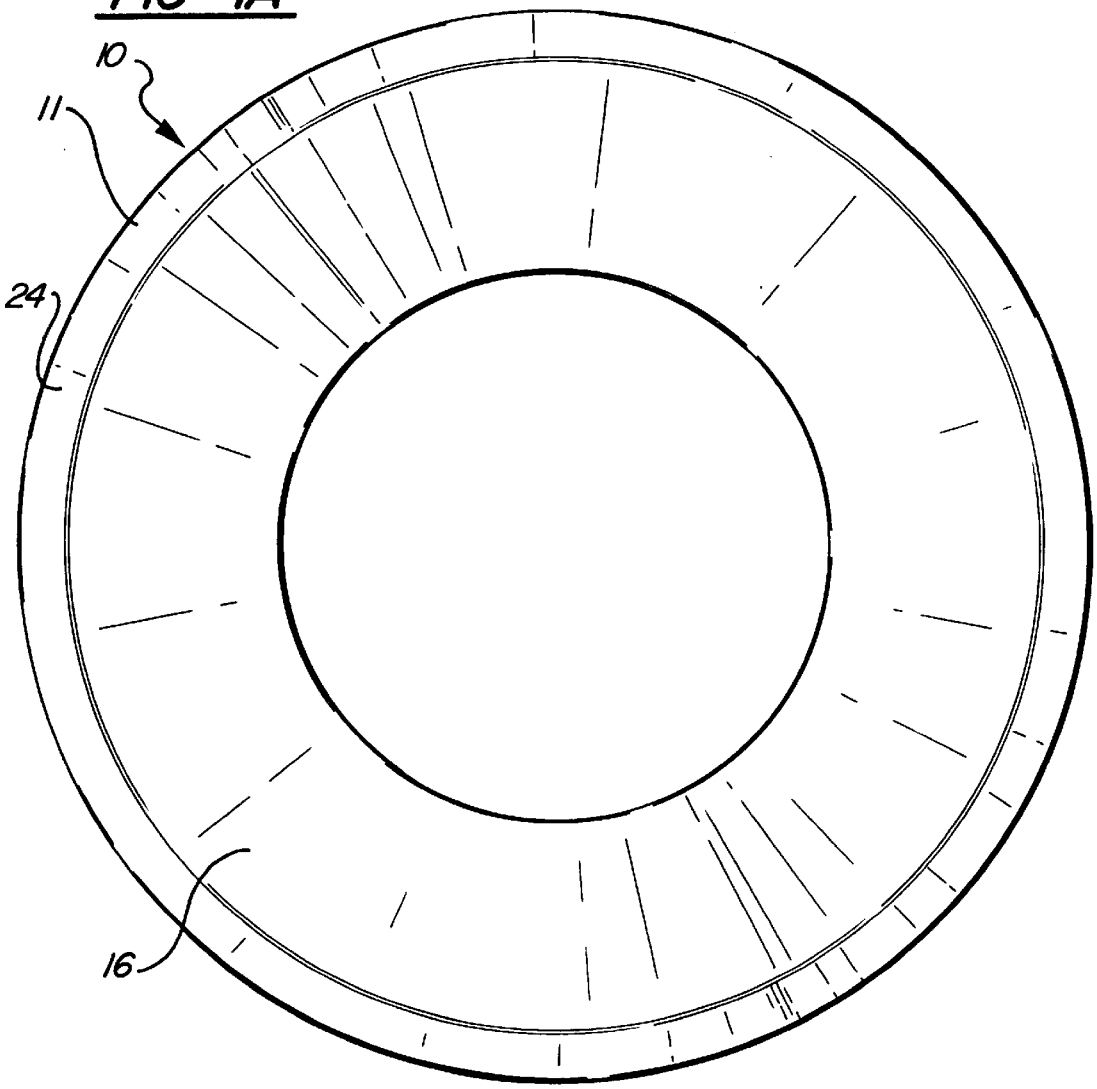
FIG. 1A is a top elevational view of the preferred embodiment of the flying toy apparatus of the present invention having a hollow circular concentric section in the center floatation member.
Figure 1B:
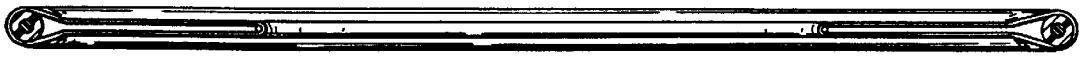
FIG. 1B is a side sectional view of the flying toy apparatus of the present invention shown in FIG. 1A.

The flying toy apparatus 10 of the present invention as shown in FIGS. 1A and 1B comprises an outer section 11 and a central floatation member 16. In this first preferred embodiment, the assembled flying toy apparatus 10 has the general shape of a flying hoop and the central floatation member 16 is a sleeve. The outer section 11 includes an annular ring 24 made of a solid material encased within a cushion-type tubular material 26. The cushion-type tubular material 26 is preferably a foam plastic or rubber, having a split longitudinally positioned to enable the individual segments to be positioned through the split during assembly.

The flying toy apparatus 10 includes an outer pocket 12 and an inner pocket 14 generally defining the outer and inner extent of a sleeve 16. The sleeve 16 has a generally annular shape when the flying toy apparatus is a flying hoop and has a continuous surface when the apparatus is a flying disc. Sleeve 16 is preferably formed of a light weight fabric material. The fabric material is stretchable so that when pulled tautly around a core to form flying toy apparatus 10, the fabric surface will be smooth and aerodynamically stable. The sleeve material is preferably Lycra® spandex or nylon.

The sleeve 16 is formed of an elongated piece of material having two end portions 20 and 22 which are fastened together as described below. The outer pocket 12 and inner pocket 14 as shown in FIGS. 1A and 1B are concentric around a center 18 and formed of the same material as sleeve 16. As will be described further below, outer pocket 12 and inner pocket 14 may be formed by folding a portion of sleeve 16 against itself and sewing the material back to sleeve 16.

A cross-sectional view of flying toy apparatus 10 of the present invention is shown in FIG. 1B. The outer pocket 12 has a circular ring 24 disposed therein. The circular ring 24 as shown in FIGS. 1A and 1B is not a permanent structure, but rather can be disassembled as hereinafter described. The circular ring 24 in FIGS. 1A and 1B is formed of a semi-rigid material that can be bent into a circular ring 24 during assembly. One suitable material for circular ring 24 is fiberglass-reinforced plastic.

A foam tube 26 is disposed about circular ring 24. The tube 26 has an inner diameter sized to receive circular ring 24. The tube 26 has an outer diameter to fit within outer pocket 12. The tube 26 may be made from a foam rubber material. The foam plastic or rubber-like material provides a resilient surface that is easy to grip and throw.

The inner pocket 14 has a shock cord 28 disposed therein. The shock cord 28 is preferably an elastic or stretchable material. The shock cord 28 is used to provide tension to hold sleeve 16 taut between outer pocket 12 and inner pocket 14. The shock cord 28 is an endless ring that is readily deformable when not under tension.

FIGS. 2A, 2B, 2C, 2D, and 2E depict the various components of the disassembled flying toy apparatus 10 of the present invention. The sleeve 16 is collapsed for storage and is fully extended once the apparatus is fully assembled (see FIGS. 2A and 2B). The shock cord 28 is retained within inner pocket 14 which together with sleeve 16 is easily collapsible for storage.

The circular ring 24 comprises a plurality of interconnecting ring segments 30 (see FIG. 2C). In the preferred embodiment, interconnecting ring segment 30 are formed from fiberglass-reinforced plastic materials. The interconnecting ring segments 30 are straight elongated rods and are bent during assembly to form the annular ring, and have a solid cross-section. Ring segments that are arcuate may also be used, since such segments will require less force to assemble and are less likely to cause injury during assembly or disassembly.

The interconnecting ring segments 30 have a ferrule 32 disposed on a first end 34 thereof. The ferrule 32 is a metal tubular extension of interconnecting ring segments 30. Each interconnecting ring segment 30 has a second end 36 sized to be received within ferrule 32.

Referring now to FIG. 2D, a pair of tubes 26 are used. The tubes 26 are formed of a foam rubber or plastic material that is soft to ease any force upon impact. The tubes 26 are pliable and easily stored.

The carrying pouch 38 is large enough to transport the interconnecting ring segments 30, the sleeve 16 and the tubes 26. The carrying pouch 38 is formed of a durable cloth-like material such as nylon or the like. The carrying pouch 38 may have a draw string 40 used to secure the open end to prevent the components of flying toy apparatus 10 from being misplaced.

Figure 3A:
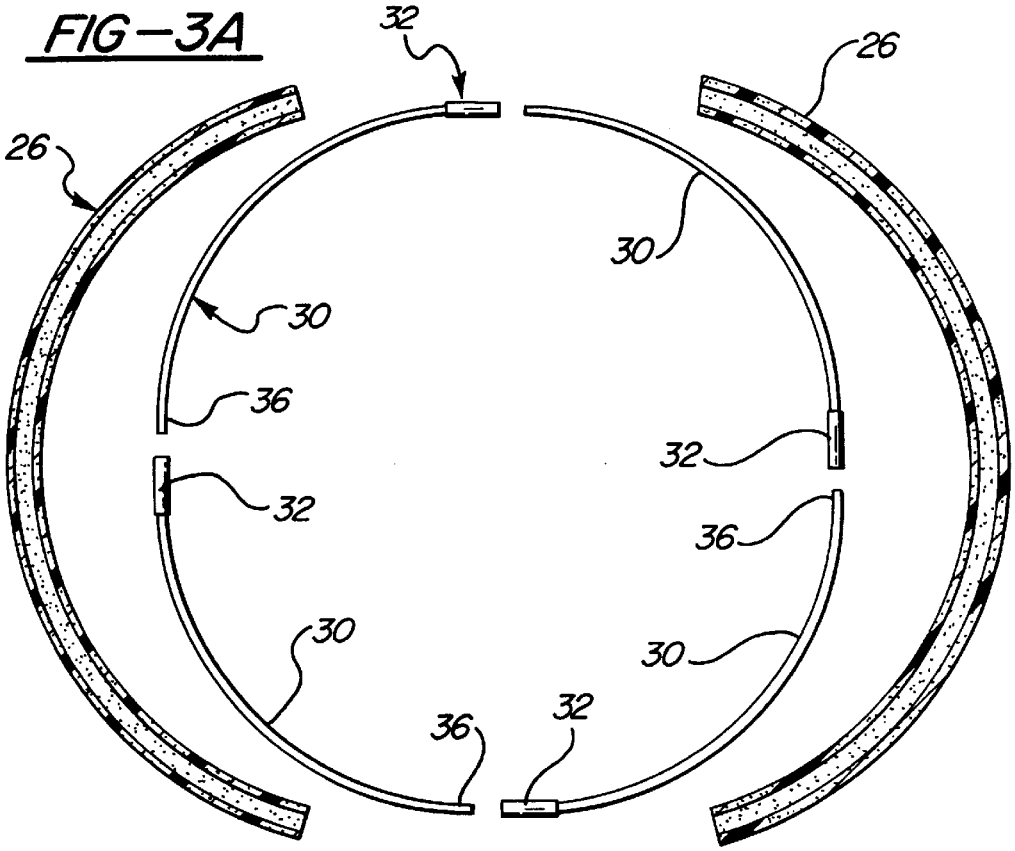
FIG. 3A is a top elevational view of the preferred embodiment of the interconnecting ring segments and the cushioned cylinders prior to assembly.
Figure 3B:
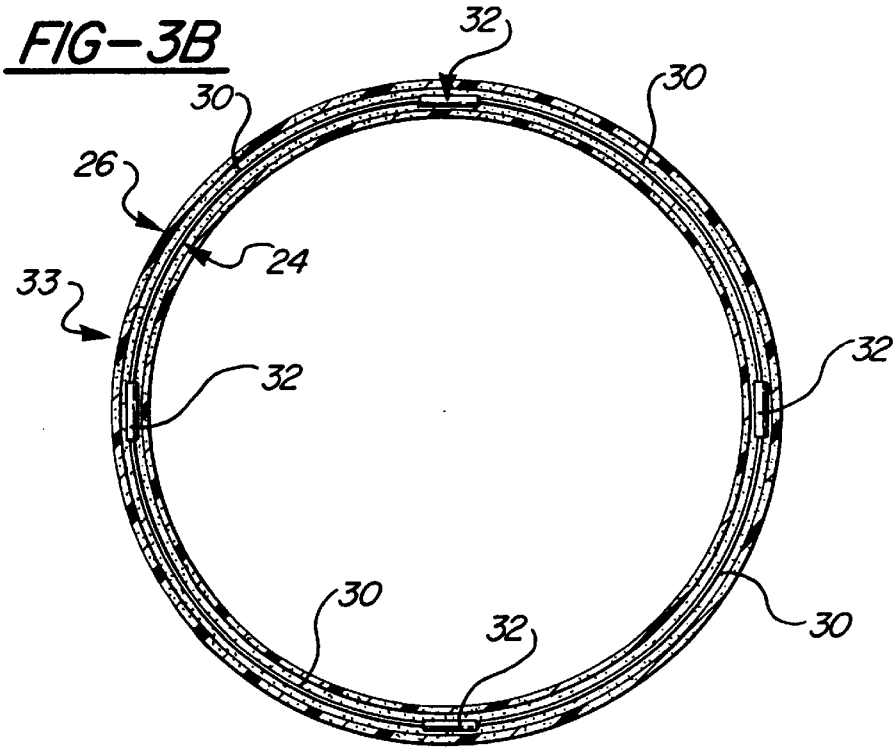
FIG. 3B is a top elevational view of FIG. 3B after assembly.

Referring now to FIGS. 3A and 3B, pressure is applied to the interconnecting ring segments 30 to bend them to form an annular ring by inserting each second end 36 into ferrule 32. The tubes 26 are then placed around the circular ring 24 to form a core 33. The tubes 26 will completely encase ring segments 30.

Figure 4A:
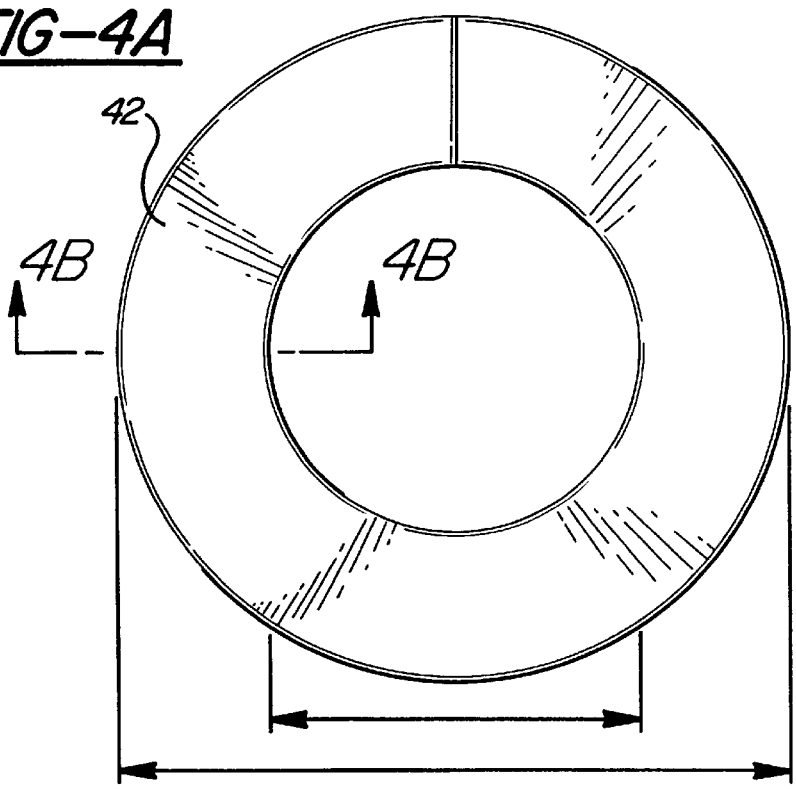
FIG. 4A is a top elevational view of the preferred embodiment of the flying toy apparatus of FIGS. 1A and 1B.

An assembled flying toy apparatus 10 of the present invention is shown in FIG. 4A. Prior to assembling the interconnecting ring segments 30, a pair of interconnected ring segments 30 and tube 26 (the core 33) are inserted through sleeve 16.

Figure 4B:
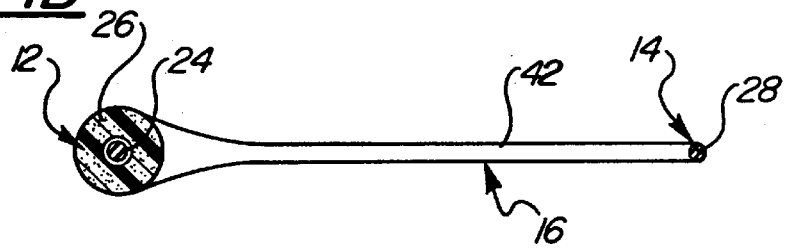
FIG. 4B is a side sectional view of FIG. 4A, the cross-section being circular.

Referring now to FIG. 4B, the tube 26 is shown as circular when disposed about circular ring 24. The sleeve 16 thus forms an annular ring 42 between outer pocket 12 and inner pocket 14.

Figure 4C:
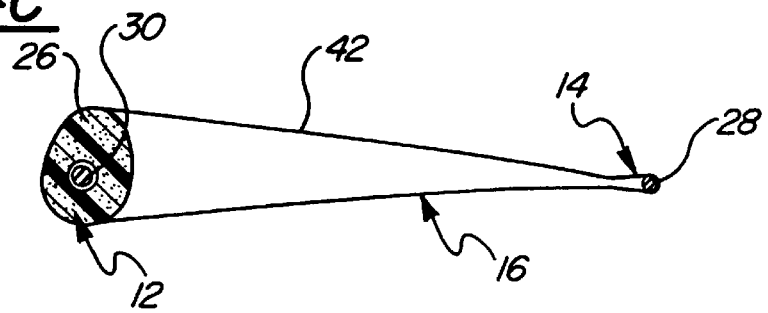
FIG. 4C is a side sectional view of FIG. 4A showing another embodiment, the cross-section being asymmetrical.

Referring now to FIG. 4C, tube 26 may be an irregular shape to provide a different aerodynamic effect. In FIG. 4C, the outer pocket 12 extends almost entirely across the annular ring 42 to the inner pocket 14. That is, outer pocket 12 has its thickest dimension at tube 26 and tapers until it joins outer ring 42. Thus, an airfoil-type shape is formed by outer pocket 12.

A disc-shaped flying toy apparatus 50 is another embodiment of the present invention and is disclosed in FIG. 5. The central floatation member 66 extends between the circular outer section 11 to form a continuous upper and lower surface so as to provide improved aerodynamic properties.

Figure 5A:
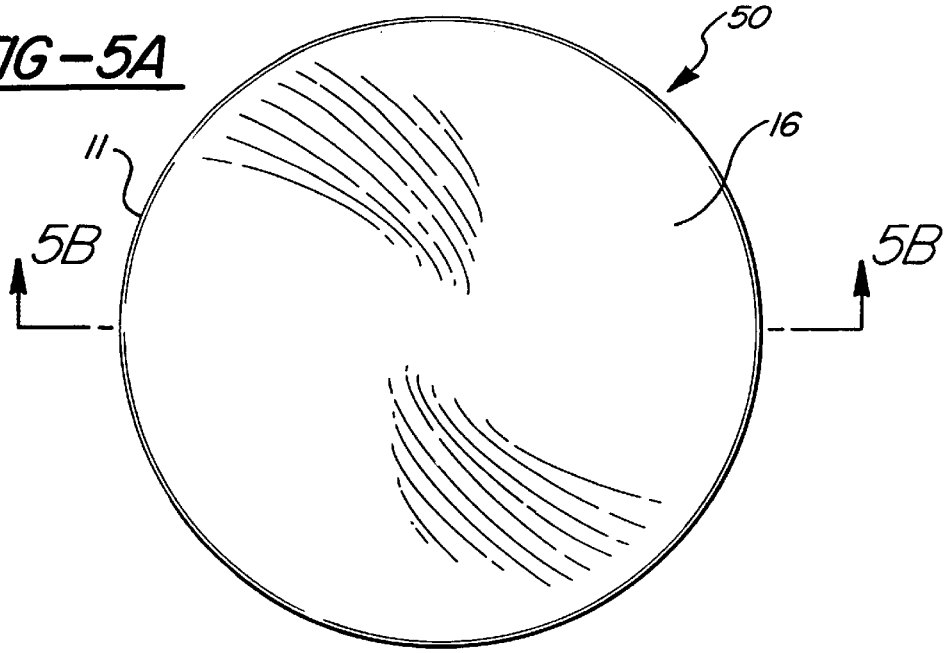
FIG. 5A is a top elevational view of the preferred embodiment of the flying toy apparatus device of the present invention in the shape of a disc.
Figure 5B:
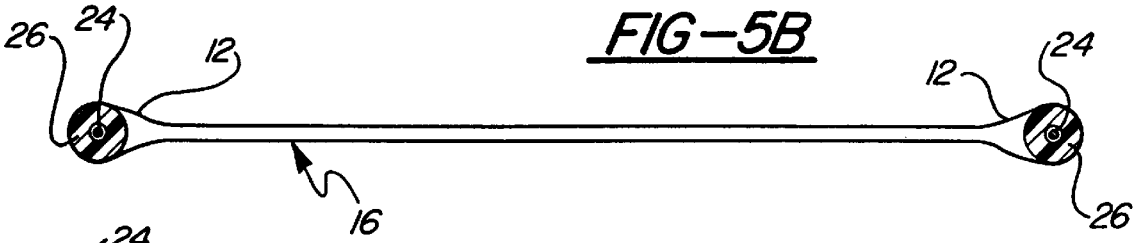
FIG. 5B is a side sectional view a first embodiment of a flying disc taken from FIG. 5A and having a circular cross-section with a two-layered central floatation member.
Figure 5C:
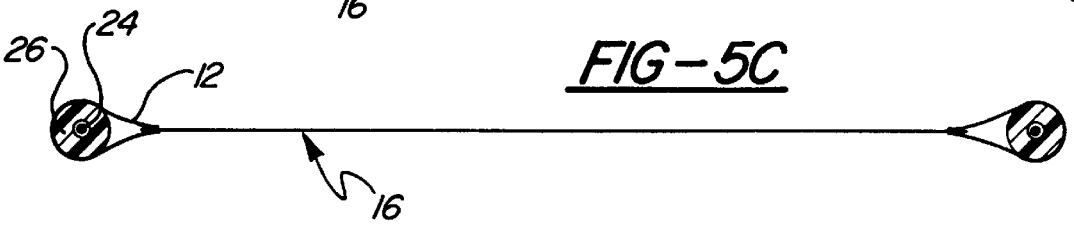
FIG. 5C is a side sectional view of a second embodiment the flying disc taken from FIG. 5A having a circular cross-section and a single layered central floatation member.
Figure 5D:
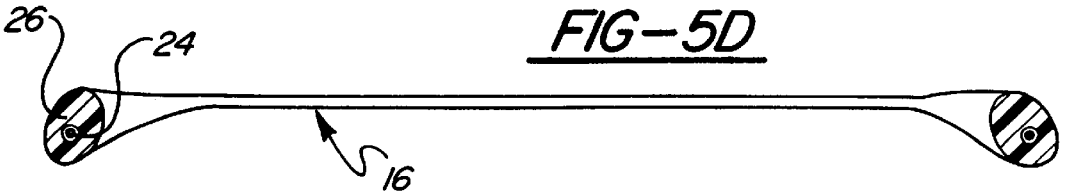
FIG. 5D is a side sectional view of a third embodiment of the flying disc taken from FIG. 5A having an asymmetrical cross-section with a two-layered central floatation member.

The continuous upper surface of the central floatation member 16 is either a sleeve and similar to the sleeve of the first embodiment (see FIGS. 5A and 5C) or the upper surface is a solid member, such as used in a Frisbee® (see FIG. 5B and 5D).

The outer pocket 12 is formed continuously with central floatation member 16 in the embodiment depicted in FIG. 5B. The spacing between the outer central floatation members is essentially formed of two layers of central floatation member 16.

The central floatation member 16 in FIG. 5C has a single layer between outer pocket 12. The outer pocket 12 may be assembled by sewing. The outer pocket 12 may, for example, be formed of a different color material than that of central floatation member 16 to form patterns that enhance the beauty of the flight pattern of the flying toy apparatus.

Another alternative embodiment of the disc-shaped flying toy apparatus 50 is shown in FIG. 5D. The variation shown in FIG. 5D is similar to that of FIG. 5B except that tube 26 has an asymmetrical and elongated shape. By making the tube 26 more elongated, the geometry of the airfoil changes, providing a variety of differing lift patterns and flight characteristics. The elongated shape of tube 26 causes outer pocket 12 to be slightly longer. The elongated shape of tube 26 causes an airfoil type shape to be formed by outer pocket 12.

Figure 5E:
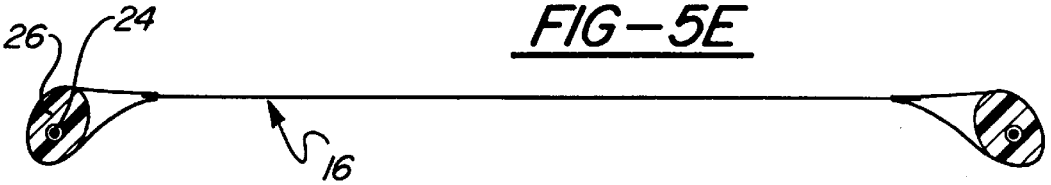
FIG. 5E is a side sectional view of a fourth embodiment of the flying disc taken from FIG. 5A having an asymmetrical cross-section and a single layered central floatation member.

In the embodiment shown in FIG. 5E, the tube 26 has an elongated shape similar to that of FIG. 5D. The central floatation member 16 has a single layer between outer pocket 12.

Figures 6A, 6B, 6C, 6D, 6E, 6F:
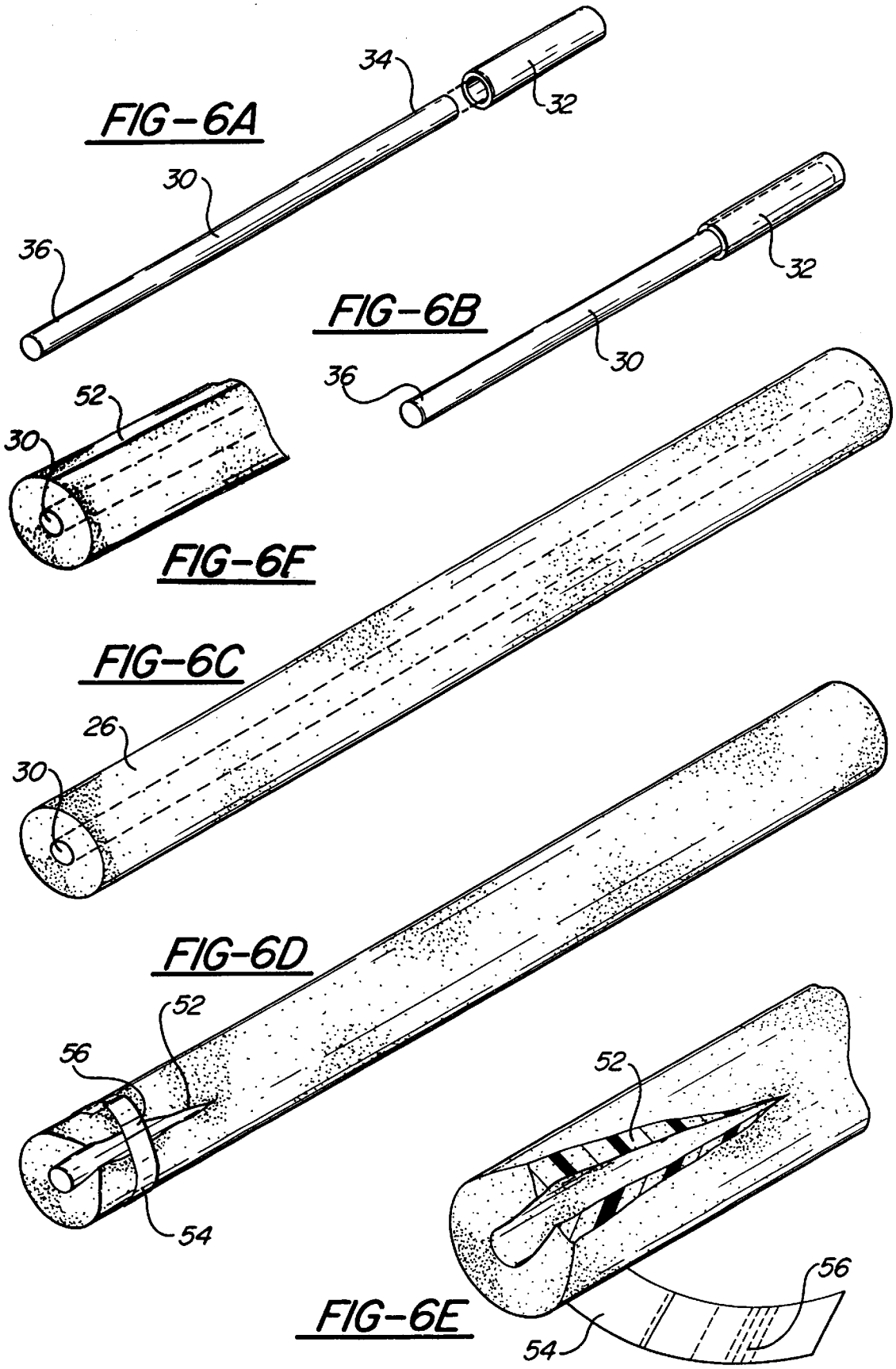
FIG. 6A shows an exploded view of the rod and ferrule of FIG. 2C prior to attachment.
FIG. 6B shows a view of the rod and ferrule of FIG. 2C after attachment.
FIG. 6C shows a view of one of the cushioned tubes of FIG. 2D.
FIG. 6D shows a view of the other cushioned tube with a strap and the split end.
FIG. 6E shows an exploded view of the cushioned tube of FIG. 6D.

As is generally depicted in FIGS. 6A and 6B, the interconnecting ring segments 30 have a solid cross sectional material. The interconnecting ring segments 30 have a first end 34 onto which ferrule 32 is coupled. The attachment may be by adhesive or crimping in a conventional manner. A portion of ferrule 32 extends beyond the end of interconnecting ring segment 30 so that a second end 36 of an adjacent interconnecting ring segment 30 may be inserted therein. The ferrule 32 provides an interference fit so that some pressure must be applied before a second end 36 can be removed from ferrule 32. However, the second end 36 is readily removable for disassembly.

An interconnecting ring segment 30 is shown in FIGS. 6C, 6D and 6E disposed within a tube 26. The tube 26 includes a longitudinal split 52 disposed along the entire axis thereof. The split 52 allows the interconnecting ring segments 30 to be easily assembled.

A strap 54 may be used to hold tube 26 together at split 52 during assembly. Strap 54 is formed of a pliable material, such as cloth. It is preferred that strap 54 be permanently coupled to tube 26 to prevent loss. The strap 54 may, however, be a separate piece. The strap 54 has a fastener such as a hook and loop fasteners coupled thereto. Thus, when the strap 54 is wrapped around tube 26, the hook portion of the hook-and-loop type fasteners 56 engage each other. In another embodiment, the split 52 extends only a portion of the length of tube 26 and the ring segments are forced through the center of the tube during assembly. As would be evident to those skilled in art, other fasteners such as snaps or clips may be used to hold strap 54 together.

To assemble the flying toy apparatus 10 of the present invention, the carrying pouch 38 is opened and the parts are removed. Initially two of interconnecting ring segments 30 are connected together by means of the ferrules and inserted into one of the two foam tubes 26.

The central floatation member 16 is then pulled and slid onto this same foam tube 26. The tube 26 is slid into the smaller part of the central floatation member 16, and portions of the central floatation member 16 remain bunched up. At this point, the fiberglass reinforced rods are inside in the foam tube 26 to add stiffness and support while the central floatation member 16 is positioned.

One end of this assembly is then anchored against a solid object, like the corner of the wall, the bottom of a bookcase. The other pair of the interconnecting ring segments 30 are then secured together. The ends of the interconnecting ring segments 30 slide and click together inside the ferrule 32. All four interconnecting ring segments 30 must be completely secured within the connecting ferrules 32. The second pair of interconnecting ring segments 30 are slid into the split of the foam tube 26.

The assembly is held in both hands level with the ground. An inch or so of the interconnecting ring segment 30 protrudes from the uncut end of the foam tube 26. The entire kit is now bent in the middle in an arcuate manner to initiate the formation of a circle. Once the interconnecting ring segments 30 form the circle, the tension will lock the ferrules 32 together and secure the rods therewithin. The cut foam tube 26 is compressed so that it is aligned with the opposing end of the foam tube 26. The ends of the strap 54 are fastened to close and retain the tube 26.

The central floatation member 16 is stretched about the circular ring 24. The fabric is continually pulled and stretched until it becomes smooth and taut. Both ends 20 and 22 may need to be stretched to fully work the central floatation member material around the core.

The opposite ends of the central floatation member 16 first are connected with the hook and eye on the respective first end 20 and second end 22 of the sleeve 16. The central floatation member 16 is evenly spaced around shock cord 28. The apparatus 10 is now ready for use.

To disassemble, the hooks on the central floatation member 16 are initially disconnected. The central floatation member 16 is then removed from one of the foam tubes 26. The strap on the cut end of the foam tube 26 is released. With the bottom of the circle on the ground, the apparatus is again compressed into a flattened oval until the interconnecting ring segments 30 are parallel with the ground. The interconnecting ring segments 30 are then released and separated from the foam tubes 26. The central floatation member 16 may remain bunched on the foam tube 26. The individual components are then stored into the pouch 38.

Hard, rough surfaces like the street, concrete or asphalt playgrounds may scuff the Lycra® spandex and shorten the life of central floatation member 16. It is recommended that the flying toy apparatus 10 of the present invention be used for playing on grass or sand to prolong the life of the central floatation member 16. The foam tubes 26 and the fiberglass-reinforced interconnecting ring segments 30 are nearly indestructible in normal use. Care must be taken with the fiberglass rods, as the bare fiberglass rod hoop can inflict pain and damage if used without the foam tubes 26.

Generally, the flight pattern comprises three phases. During the initial acceleration phase, the velocity of the apparatus 10 continues to increase until a maximum speed and altitude have been achieved. The second phase is the hovering phase, whereby the speed of the apparatus 10 begins to decelerate and the apparatus 10 begins its ascent. The landing phase begins when the ascent becomes more pronounced as the apparatus 10 and the speed is further reduced.

The flying hoop apparatus 10 of the present invention is adaptable to other sizes and to airfoils having other shapes. For example, by adding or removing one or more additional interconnecting ring segment the size of the flying toy apparatus 10 can be changed dramatically. Additional sleeves are needed to change size, since the sleeve is only useful for a toy apparatus 10 of a fixed diameter.

Also, the flight characteristics can be varied either by (1) using a plurality of ring segments having a differing cross-sectional geometry; or (2) using cushioned tubes having asymmetrical cross-sections.

The flying toy apparatus 10 of the present invention preferably has an outer diameter of from between 16 to 36 inches end to end, and more specifically, between 25 and 35 inches. The center opening has a diameter of between 12 and 21 inches, and more specifically, between 14 and 18 inches. The larger diameter for the center opening enables the flying apparatus 10 to be used in a game of catch, whereby the player catches the apparatus 10 when the apparatus 10 is lands about a player. When larger geometries are used, it enables the players to catch the hoop shaped apparatus 10 by positioning a player beneath the toy while the toy is in the hovering stage and enabling the player to stand within the opening of the central floatation member.

It is further noted that while the apparatus 10 of the present invention can be launched like as Frisbee® by imparting a large initial torque, the apparatus 10 is preferably launched by simply propelling the apparatus 10 with a large force forward into the air. This method is preferred since it enables improved control of the apparatus 10 by players involved in a game of catch. Also, such a launch force can be readily imparted by a mechanical spring force, whereby the apparatus 10 is loaded into a launch chamber and released by a trigger type action. One or more of the devices can be so loaded and launched sequentially.

It will be readily seen by those skilled in the art that the principles of the present invention have applications other than games, such as for testing various airfoil geometries and for target practice.

While the figures illustrate a flying toy apparatus 10 that can be readily disassembled and stored, such a toy may also be formed of a permanent structure following the teachings of the present invention as would be evident to those skilled in the art.

It is evident that many alternatives, modifications, and variations of the flying toy apparatus 10 and assembly method of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

I claim:

1. A flying apparatus comprising:

an outer section having an annular ring, the annular ring being made of a solid and substantially rigid material, the annular ring having a substantially circular cross-section, the annular ring enabling firm grasping of the outer section during launch, the outer section including a cushion-type material surrounding all external surfaces of the annular ring, the cushion-type material lessening any force imposed by the annular ring upon impact; and a central flotation member affixed and positioned within the outer annular section, the outer annular section in combination with the central floatation member forming an airfoil, the airfoil shape enabling prolonged flight patterns.

2. The flying apparatus of claim 1, wherein the central floatation member has a centrally disposed opening therewithin, the opening being of sufficient size to fit about the body of a participant.

3. A flying disc-shaped apparatus comprising:

an outer section having an annular ring, the annular ring being made of a solid and substantially rigid material, the annular ring enabling firm grasping of the outer section during launch, the outer section including a cushion-type material surrounding all external surfaces of the annular ring, the cushion-type material lessening any force imposed by the annular ring upon impact; and a central floatation member affixed and positioned within the outer annular section, the central floatation member having a continuous surface disposed within the annular ring, the outer annular section in combination with the central floatation member forming an airfoil, the airfoil shape enabling prolonged flight patterns.

4. The flying apparatus of claim 1, wherein the annular ring comprises a plurality of interconnecting individual segments.

5. The flying apparatus of claim 1, wherein a center of a half-section of the annular ring is substantially concentric with a center of a half-section of the cushion-type material.

6. A flying apparatus comprising:

an outer section having an annular ring, the annular ring being made of a solid and substantially rigid material, the annular ring enabling firm grasping of the outer section during launch, the solid material being comprised of a plurality of interconnecting individual segments securely retained relative to each other; and a central floatation member affixed and positioned within the outer annular section, the outer annular section in combination with the central floatation member forming an airfoil, the airfoil shape enabling prolonged flight patterns.

7. The flying apparatus of claim 6, wherein the central floatation member has a centrally disposed opening therewithin, the opening being of sufficient size to fit about the body of a participant.

8. The flying apparatus of claim 6, wherein the central floatation member has a continuous surface disposed within the annular ring forming a disc.

9. The flying apparatus of claim 6, wherein the annular ring has a substantially circular cross-section.

10. The flying apparatus of claim 9, wherein the annular ring has an asymmetrical cross-section.

11. The flying apparatus of claim 6, further comprising a cushion-type material disposed about the annular ring, the cushion-type material having a substantially circular cross-section.

12. The flying apparatus of claim 6, further comprising a cushion-type material disposed about the annular ring.

13. A sleeve apparatus for use with a flying apparatus, the sleeve having first and second ends and being made from a stretchable material, the sleeve having a stretched condition and a relaxed condition, the sleeve apparatus comprising:

an inner pocket housing therewithin a stretchable member having a generally circular shape when in a stretched condition;

an outer pocket for retaining therewithin an annular ring that is substantially rigid upon impact; and means for securing the first end of said sleeve apparatus to the second end of said sleeve apparatus, the first end of said sleeve apparatus being readily attachable to and detachable from the second end of said sleeve apparatus enabling ease of assembly and disassembly;

whereby a central floatation member is formed upon attachment of the first sleeve portion to the second sleeve portion.

14. The sleeve apparatus of claim 13, wherein the securing means is a plurality of hooks and catches.

15. A method for assembling a flying apparatus comprising:

providing a sleeve having an outer pocket for retaining a solid member therewithin;

connecting a plurality of interconnecting segments together to form a linear assembly, the individual segments being attachable in a secure manner relative to each other in an axial direction;

inserting the interconnected segments into the outer pocket of the sleeve;

retaining outer extremities of the interconnected segments together to form an annular ring structure;

spreading the sleeve about the annular ring structure; and joining ends of the sleeve together to form a central floatation member, the central floatation member and the annular ring structure forming an airfoil.

16. The assembly method of claim 15, further comprising positioning a pair of the interconnected segments into a cushion-type material prior to inserting the interconnected segments within the sleeve.

17. A flying apparatus comprising:

an outer section having an annular ring, the annular ring being made of a solid and substantially rigid material, the annular ring enabling firm grasping of the outer section during launch, the annular ring having a substantially circular cross-section, the outer section including a cushion-type material that lessens any force imposed by the annular ring upon impact, the cross-section of the annular ring and the cushion-type material being concentric; and a central floatation member affixed and positioned within the outer annular section, the outer annular section in combination with the central floatation member forming an airfoil, the airfoil shape enabling prolonged flight patterns.

18. A flying apparatus comprising:

an outer section having an annular ring, the annular ring being made of a solid and substantially rigid material, the annular ring enabling firm grasping of the outer section during launch, the annular ring having a substantially circular cross-section, the outer section including a cushion-type material that lessens any force imposed by the annular ring upon impact, the external surface of the annular ring being generally the same shape as the external surface of the cushion-type material; and a central floatation member affixed and positioned within the outer annular section, the outer annular section in combination with the central floatation member forming an airfoil, the airfoil shape enabling prolonged flight patterns.

* * * * *